United States Patent [19]

Hall

[11] 3,931,037

[45] Jan. 6, 1976

[54] SUBSTANTIALLY UNCOLORED DETERGENT PRODUCTS CONTAINING COLORING MATERIALS

[75] Inventor: Randall Brian Hall, Cincinnati, Ohio

[73] Assignee: The Procter & Gamble Company, Cincinnati, Ohio

[22] Filed: Nov. 1, 1973

[21] Appl. No.: 411,883

Related U.S. Application Data

[63] Continuation of Ser. No. 202,600, Nov. 26, 1971, abandoned.

[52] U.S. Cl. ..... 252/135; 252/173; 252/528; 252/525; 252/539; 252/544; 252/547; 252/558; 8/77; 8/79

[51] Int. Cl.[2] ..... C11D 3/06

[58] Field of Search ..... 252/135, 89, 539, 528, 252/525, 544, 547, 558; 8/77, 79; 264/117; 23/313

[56] References Cited

UNITED STATES PATENTS

| | | | |
|---|---|---|---|
| 2,059,449 | 11/1936 | Fowler et al. | 8/6 |
| 2,930,760 | 3/1960 | Gebhardt | 252/110 |
| 3,123,565 | 3/1964 | Millsaps et al. | 252/135 |
| 3,154,496 | 10/1964 | Roald | 252/99 |
| 3,451,935 | 6/1969 | Roald et al. | 252/135 |
| 3,519,570 | 7/1970 | McCarty | 252/135 |
| 3,529,923 | 9/1970 | Perry et al. | 8/77 |
| 3,687,640 | 8/1972 | Sams et al. | 23/313 |

FOREIGN PATENTS OR APPLICATIONS

| | | | |
|---|---|---|---|
| 586,019 | 10/1959 | Canada | 8/77 |

*Primary Examiner*—Leland A. Sebastian
*Assistant Examiner*—E. Suzanne Parr
*Attorney, Agent, or Firm*—Richard C. Witte; Thomas H. O'Flaherty; Edmund F. Gebhardt

[57] ABSTRACT

Substantially uncolored detergent products containing coloring materials are prepared by mixing the coloring materials in a dry particulate form with a granular material to form a composition to be incorporated in a granular detergent product. With continuous mixing, water or other liquid materials are sprayed on the mixture containing the coloring material to form substantially uncolored agglomerated granules.

3 Claims, No Drawings

SUBSTANTIALLY UNCOLORED DETERGENT PRODUCTS CONTAINING COLORING MATERIALS

This is a continuation, of application Ser. No. 202,600 filed Nov. 26, 1971, now abandoned.

BACKGROUND OF THE INVENTION

Colored granular detergent products are well known. Also well known are distinctively colored granular detergent products containing dyes or pigments which have a beneficial "bluing" effect on fabrics resulting in an improvement of apparent fabric whiteness. U.S. Pat. No. 2,930,760 issued Mar. 29, 1960 describes the use of the water-soluble dye, Polar Brilliant Blue GAW (similar to C.I. 61135), as an effective non-staining bluing agent in a detergent product. U.S. Pat. No. 3,529,923 issued Sept. 22, 1970, describes a bluing composition containing the water-insoluble pigment Ultramarine Blue (C.I. 77007) which has a greatly reduced potential for staining fabrics.

The preparation of colored granular detergent products is generally accomplished by mixing a coloring material into a detergent composition prior to spray drying it into granules. Alternatively, coloring materials can be present in only a portion of the granules in the total detergent product to provide a speckled appearance. These speckles can be prepared by spray drying. They can also be prepared by an agglomeration method, such as described in U.S. Pat. No. 3,035,301 issued May 22, 1962, which utilizes water solutions of adhesives to agglomerate hydratable salts. A coloring material can be present in the adhesive solution to provide a colored speckle. Still another alternative is provided by U.S. Pat. No. 2,889,283 issued Apr. 29, 1956 which describes a process for spraying a water solution or suspension of a coloring material onto a diverted portion of a granular detergent composition process stream. A speckled appearance results by blending the undiverted and uncolored stream with the stream subjected to the spray containing a coloring material.

All these methods provide a distinctly visible color to the finished granular detergent product. definite In order to meet the requirements of some users of granular detergent products and to minimize fabric staining due to localized high concentrations of coloring material, it is desirable to provide a granular detergent product that is substantially uncolored in its dry state yet contains sufficient coloring material to provide a definiate color to a washing solution. Additionally, depending on the coloring material used, it is desirable to provide a benefit to fabrics washed in such solutions.

Canadian Pat. No. 586,019 issued Oct. 27, 1959 describes a granular detergent composition in which a coloring material is distributed in a dry state and in a state of subdivision such that the dry composition is not appreciably colored. The process by which these compositions are prepared does not result in agglomeration or adhesion of the coloring material to prevent subsequent separation from the bulk of the composition.

It is an object of the present invention to provide a granular detergent product substantially uncolored in its dry state which contains coloring materials that are not subject to separation and segregation and are readily soluble or dispersible when the granular detergent product is mixed with water to form a washing solution.

DESCRIPTION OF THE INVENTION

This invention pertains to a substantially uncolored granular detergent product containing coloring materials which provide a distinct color to a washing solution. Depending on the material chosen, these coloring materials may additionally provide a benefit to fabrics washed in such solutions. For example, the coloring materials can be effective fabric bluing agents that improve apparent fabric whiteness by counteracting a yellow discoloration of fabric due to incomplete soil removal or other causes.

Specifically, a granular detergent product is prepared by the steps of:

a. mixing together, by weight, from about 0.001 percent to about 10 percent of a dry particulate coloring material having substantially no particles larger than 150 $\mu$ with from about 90 percent to about 99.999 percent of a granular material having an average particle size of about 150 $\mu$ to 1000 $\mu$;

b. spraying onto the mixture prepared in step (a), during continuous mixing, from about 1 percent to about 15 percent, based on the total weight of (a), of a liquid material to form agglomerates of said coloring material and granular material that are substantially uncolored and not subject to separation during subsequent processing or handling.

The coloring materials contemplated for use in this invention are characterized by their ability to provide a color to washing solutions. The coloring material may be a water-soluble dye or a water-insoluble pigment capable of dispersion in water. For the purposes of this invention, the coloring material must be in a dry particulate form. It is preferable that the coloring material does not contain an appreciable percentage of particles having a size larger than 150 $\mu$. Dry particulate coloring materials that will pass through a 100 mesh Tyler screen and have less than about 3 percent by weight of particles that will not pass through a 325 mesh Tyler screen are particularly preferred.

Examples of dyes which can be utilized in this invention are: (1) Polar Brilliant Blue GAW 180 percent sold by Ciba-Geigy S.A., Basel, Switzerland (similar to C.I. ["Color Index"] 61135 - Acid Blue 127), (2) FD&C Blue No. 1 (C.I. 42090), (3) Rhodamine BM (C.I. 45170), (4) Pontacyl Light Yellow 36 (similar to C.I. 18820), (5) Polar Brilliant Blue RAW (C.I. 61585 - Acid Blue 80).

Examples of pigments which can be utilized in this invention are: (1) Phthalocyanine Blue (C.I. 74160), (2) Phthalocyanine Green (C.I. 74260), (3) Ultramarine Blue (C.I. 77007 - Pigment Blue 29).

The initial step in the practice of this invention is an intimate dry-mixing of a coloring material as described above with a granular material suitable for use in a detergent product The granular material may be a complete detergent composition in itself, a usual ingredient in a detergent composition, or any granular material not incompatible with the other ingredients or the purposes of a detergent product. A particularly preferred granular material is a hydratable salt such as sodium tripolyphosphate. Preferably, the granular material should have an average particle size of 150 $\mu$ to 1000 $\mu$. Granular materials, such as sodium tripolyphosphate are also satisfactory, which have a particle size distribution such that 90 percent by weight will pass through a 20 Tyler mesh screen and be retained on an 80 Tyler mesh screen.

The mixing of dry particulate coloring material and granular material and the spraying of agglomerating liquid material can be effected batchwise or by a continuous process. The mixing and spraying steps can be effected in one apparatus or the steps may take place in separate apparatus. A useful technique for admixing solid materials in agglomeration processes involving the addition of liquid materials utilizes a pan agglomerator such as produced by the Dravo Corporation of Pittsburgh, Pennsylvania. A Dravo-Lurgi Pan Agglomerator may be used for the practice of this invention; this is a preferred apparatus for continuous operation. A small cement mixer may also be used for the practice of the invention for a non-continuous batch operation.

Detergent compositions for laundry use contain an organic surface active agent and at least one detergency builder material generally characterized by an ability to sequester or precipitate water hardness ions such as calcium or magnesium. Builders may also be used to maintain an alkaline pH in a washing solution. The organic surface active agent can be selected from well-known classes of natural and synthetic surface active agents including anionic, nonionic, ampholytic, and zwitterionic surface active agents.

Anionic surface active agents include alkali metal soaps and the alkali metal salts of organic sulfuric reaction products such as sodium alkyl sulfate and sodium alkyl benzene sulfonate.

Nonionic surface active agents include compounds produced by the condensation of alkylene oxide groups with an organic hydrophobic compound which may be aliphatic or alkyl aromatic in nature. Also included are the amine oxides such as dimethyl alkyl amine oxide, the alkyl group containing from about 10 to about 28 carbon atoms.

Ampholytic and zwitterionic surface active agents include, respectively, compounds such as aliphatic derivatives of heterocyclic secondary and tertiary amines and derivatives of aliphatic quaternary ammonium and phosphonium or tertiary sulfonium compounds.

Suitable detergency builders can be organic or inorganic in nature. Examples of inorganic builders are the alkali metal carbonates, borates, phosphates, polyphosphates, bicarbonates, and silicates. Examples of organic builders are the alkali metal aminopolycarboxylates and polyphosphonates.

The following examples illustrate the present invention.

EXAMPLE I

The following granular detergent product containing a blue dye is prepared by an agglomeration process utilizing a 39 inch diameter Dravo-Lurgi Pan Agglomerator manufactured by the Dravo Corporation of Pittsburgh, Pennsylvania. As a granular material, a spray-dried granular synthetic detergent composition is used containing 26 percent alkyl benzene sulfonate, 32 percent sodium tripolyphosphate, 6 percent sodium silicate, 17 percent sodium sulfate, and 17 percent moisture and minor ingredients. It is added to the pan at a rate of 958 pounds per hour. The water-soluble dye Polar Brilliant Blue GAW (180 percent) is also added in a dry particulate form to the pan at a rate of 12 pounds per hour. When the pan is filled with the mixture of granular synthetic detergent and dry particulate dye, water is added at a rate of 30 pounds per hour in the form of a spray. The location of this spray is not critical for the purposes of this invention. The mixture is tumbled and thereby agglomerated to form a dye-containing detergent composition. When the pan agglomerator reaches a state of continuous operation, about 990 pounds per hour of the dye-containing granular detergent composition flows over the lip of the pan. About 10 pounds of water per hour is lost to the atmosphere. The dye-containing granular detergent composition produced is substantially uncolored but for a slight blue hue. When added at a level of about 1 percent to about 10 percent to a spray-dried granular detergent composition having a white color, the total product is uncolored, the slightly blue hue being completely masked by the white color of the overall product.

The advantages of Example I can be illustrated by the following. The same quantity of Polar Brilliant Blue GAW (180 percent) added to the total product or any portion of the product before the spray drying step produces a definite coloration in the final product. A definite coloration is also produced if the same quantity of dye is dissolved in the water added to the pan agglomerator.

EXAMPLE II

The following granular product containing a blue dye is prepared according to the process and other conditions of Example I except anhydrous sodium tripolyphosphate with a particle size such that 90 percent passes through a 20 Tyler mesh screen and is retained on an 80 Tyler mesh screen is the granular material and is substituted for the spray-dried granular synthetic detergent composition in the pan agglomerator. A comparable visual result, i.e., a substantially uncolored detergent product such as that described in Example I, is obtained when about 1 percent to about 10 percent of the pan agglomerator composition is mixed with 95 percent to 99 percent of a spray-dried granular detergent composition having a white color.

What is claimed is:

1. A process for preparing a granular composition for use in a granular detergent product comprising the steps of:

a. mixing together, by weight, from about 0.001 percent to about 10 percent of a dry particulate coloring material selected from the group consisting of Polar Brilliant Blue GAW 180 percent, FD&C Blue No. 1, Rhodamine BM, Pontacyl Light Yellow 36, Polar Brilliant Blue RAW, Phthalocyanine Blue, Phthalocyanine Green, and Ultramarine Blue having substantially no particles larger than 150 $\mu$ with from 90 percent to 99.999 percent of a granular material selected from the group consisting of hydratable salts and detergent compositions having an average particle size of about 150 $\mu$ to about 1000 $\mu$;

b. spraying onto the mixture prepared in step (a) during continuous mixing, from about 1 percent to about 15 percent, based on the total weight of (a), of water to form agglomerates of said coloring material and said granular material.

2. The process of claim 1 wherein the granular material is sodium tripolyphosphate.

3. The process of claim 1 wherein the coloring material is a fabric bluing agent selected from the group consisting of Ultramarine Blue, Polar Brilliant Blue GAW, and Polar Brilliant Blue RAW.

* * * * *